US011810543B2

(12) United States Patent
Tu et al.

(10) Patent No.: US 11,810,543 B2
(45) Date of Patent: Nov. 7, 2023

(54) METHOD AND APPARATUS FOR AUDIO SIGNAL PROCESSING SELECTION

(71) Applicant: Acer Incorporated, New Taipei (TW)

(72) Inventors: Po-Jen Tu, New Taipei (TW); Jia-Ren Chang, New Taipei (TW); Kai-Meng Tzeng, New Taipei (TW); Ming-Chun Fang, New Taipei (TW)

(73) Assignee: Acer Incorporated, New Taipei (TW)

( * ) Notice: Subject to any disclaimer, the term of this patent is extended or adjusted under 35 U.S.C. 154(b) by 254 days.

(21) Appl. No.: 17/492,685

(22) Filed: Oct. 4, 2021

(65) Prior Publication Data

US 2022/0343889 A1 Oct. 27, 2022

(30) Foreign Application Priority Data

Apr. 21, 2021 (TW) ..... 110114321

(51) Int. Cl.

| | |
|---|---|
| ***G10K 11/178*** | (2006.01) |
| ***H04R 5/04*** | (2006.01) |
| ***G10L 21/0208*** | (2013.01) |

(52) U.S. Cl.

CPC .... *G10K 11/17827* (2018.01); *G10K 11/1785* (2018.01); *G10L 21/0208* (2013.01); *H04R 5/04* (2013.01); *H04R 2420/07* (2013.01)

(58) Field of Classification Search

None

See application file for complete search history.

(56) References Cited

U.S. PATENT DOCUMENTS

| | | | | |
|---|---|---|---|---|
| 7,464,029 | B2 * | 12/2008 | Visser | G10L 21/0272 704/215 |
| 8,208,654 | B2 | 6/2012 | Coutinho et al. | |
| 2007/0010978 | A1 | 1/2007 | Crutchfield | |
| 2011/0096942 | A1 * | 4/2011 | Thyssen | G10L 21/0208 381/94.1 |
| 2015/0373474 | A1 | 12/2015 | Kraft et al. | |
| 2021/0041953 | A1 | 2/2021 | Poltorak | |

FOREIGN PATENT DOCUMENTS

| | | |
|---|---|---|
| CN | 104160714 | 11/2014 |
| TW | 201835784 | 10/2018 |

* cited by examiner

*Primary Examiner* — Paul W Huber
(74) *Attorney, Agent, or Firm* — JCIPRNET

(57) ABSTRACT

A method and an apparatus for audio signal processing selection are provided. In the method, multiple audio signal processing operations are performed on a synthesized audio signal to generate multiple processed audio signals, the audio signal processing operations are evaluated according to the comparison results between the processed audio signals and the primary signal, and the audio signal processing operation corresponding to a designated application and the designated audio output mode is selected according to the evaluation result of the audio signal processing operations. The synthesized audio signal is generated by adding a secondary signal into a primary signal. The signal processing is related to remove the secondary signal from the synthesized audio signal. Those processed audio signals are used by the designated application at the designated audio output mode. The comparison result is related to signal similarity. The evaluation result is related to the highest signal similarity.

16 Claims, 4 Drawing Sheets

METHOD AND APPARATUS FOR AUDIO SIGNAL PROCESSING SELECTION

CROSS-REFERENCE TO RELATED APPLICATION

This application claims the priority benefit of Taiwan application serial no. 110114321, filed on Apr. 21, 2021. The entirety of the above-mentioned patent application is hereby incorporated by reference herein and made a part of this specification.

BACKGROUND

Technical Field

The disclosure generally relates to a signal analysis technique, and in particular, to an apparatus and a method for audio signal processing selection.

Description of Related Art

Conventional audio signal processing operations include various noise reduction techniques. Different audio transmission modes (for example, a built-in loudspeaker, an earphone, or an external loudspeaker) used in an application (e.g., Skype, Teams, etc.) may result in a significant difference in the effect. FIG. 1 is a diagram illustrating a conventional framework of audio transmission. Referring to FIG. 1, two paths are provided, in which an audio signal receiving end is connected to a loudspeaker, and an audio signal transmitting end is connected to a sound receiver. The application and the output mode are at a top layer 10. A signal processing technique of noise suppression is at an intermediate layer 30. An encoder/a decoder which is close to hardware is at a bottom layer 150. In practical application, while a user may change the application or the audio output mode, the conventional techniques are yet to provide an appropriate corresponding noise suppression processing technique for the application and/or the audio output mode.

SUMMARY

Accordingly, the embodiment of the disclosure is directed to an apparatus and a method for audio signal processing selection capable of providing an appropriate audio signal processing operation for a specific application and a specific audio output mode.

A method for audio signal processing selection in an embodiment of the disclosure includes (but not limited to): respectively performing multiple audio signal processing operations on a synthesized audio signal to generate multiple processed audio signals; evaluating the audio signal processing operations according to multiple comparison results of the processed audio signals and a primary signal, and selecting one of the audio signal processing operations corresponding to a designated application and a designated audio output mode according to an evaluation result corresponding to the audio signal processing operations. The synthesized audio signal is generated by adding a secondary signal into a primary signal, and the audio signal processing operations are related to removing the secondary signal from the synthesized audio signal. The processed audio signals are used by an identical designated application at an identical designated audio output mode, and the comparison results are related to a signal similarity. The evaluation result is related to one of the comparison results with the highest signal similarity.

An apparatus for audio signal processing selection in an embodiment of the disclosure includes (but not limited to) a storage and a processor. The storage is configured to store a code. The processor is coupled to the storage and is configured to load the code to execute: respectively performing multiple audio signal processing operations on a synthesized audio signal to generate multiple processed audio signals; using the processed audio signals at an identical designated audio output mode by an identical designated application; respectively evaluating the audio signal processing operations according to multiple comparison results between the processed audio signals and the primary signal and selecting one of the audio signal processing operations corresponding to the designated application and the designated audio output mode according to an evaluation result corresponding to the audio signal processing operations. The synthesized audio signal is generated by adding a secondary signal into a primary signal, and the audio signal processing operations are related to removing the secondary signal from the synthesized audio signal. The comparison results are related to signal similarity, and the evaluation result is related to one of the comparison results with the highest similarity.

In light of the above, the apparatus and the method for audio signal processing selection in the embodiments of the disclosure seek an audio signal processing operation which can output an audio signal which is the most similar to the primary signal for the designated application and the designated audio output mode. Accordingly, when the application and the audio output mode change, the most appropriate audio signal processing operation can be spontaneously switched.

To facilitate understanding of the features and advantages of the disclosure, reference will now be made in detail to the present exemplary embodiments of the disclosure, examples of which are illustrated in the accompanying drawings.

DESCRIPTION OF THE EMBODIMENTS

Figure 1:
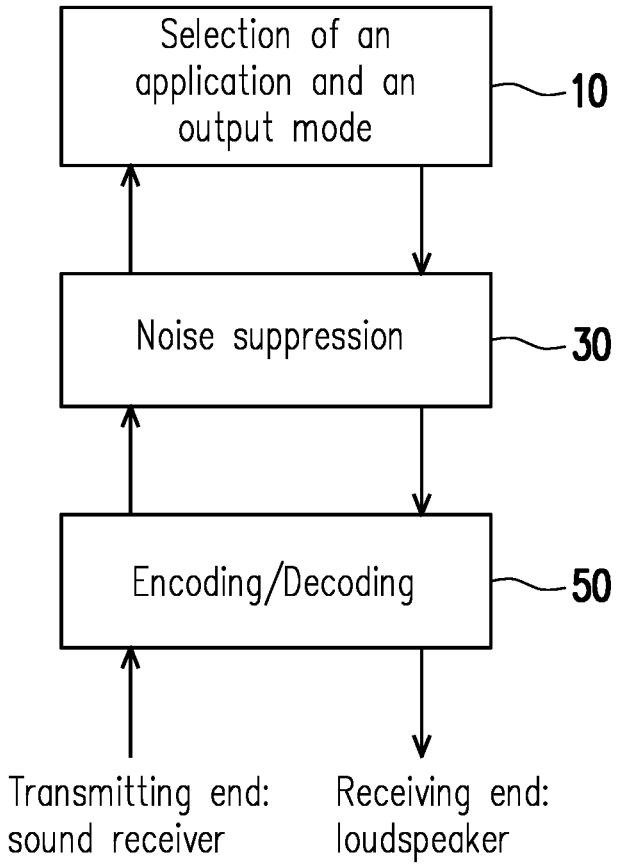
FIG. 1 is a diagram illustrating a conventional framework of audio transmission.
Figure 2A:
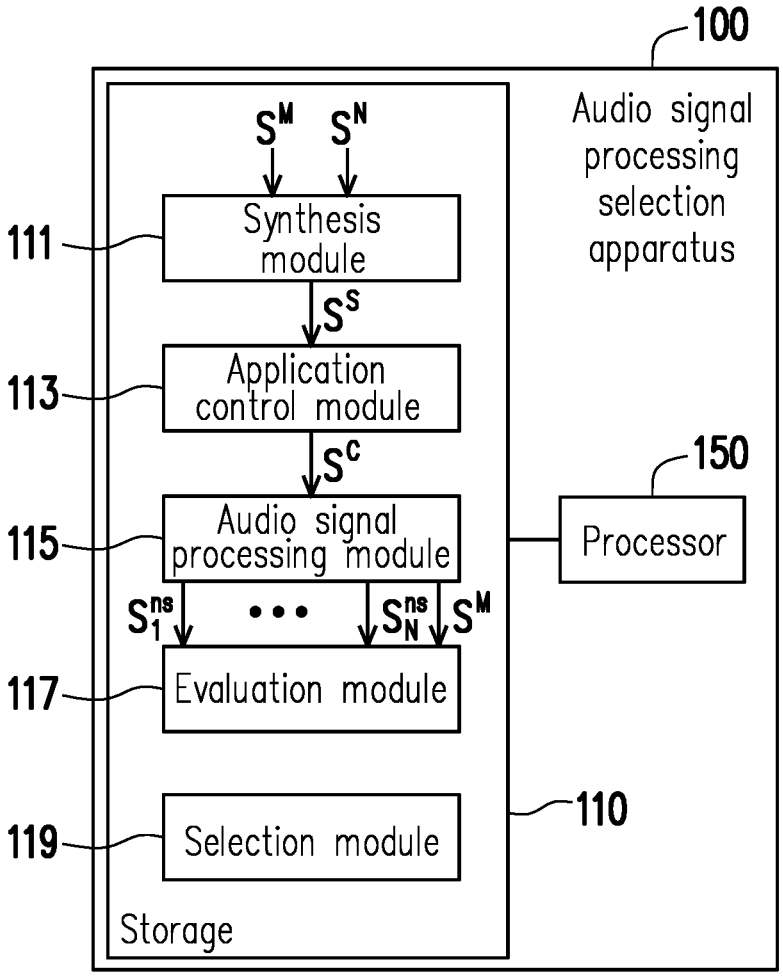
FIG. 2A is a block diagram illustrating the elements of an apparatus for audio signal processing selection according to an embodiment in the disclosure.
Figure 2B:
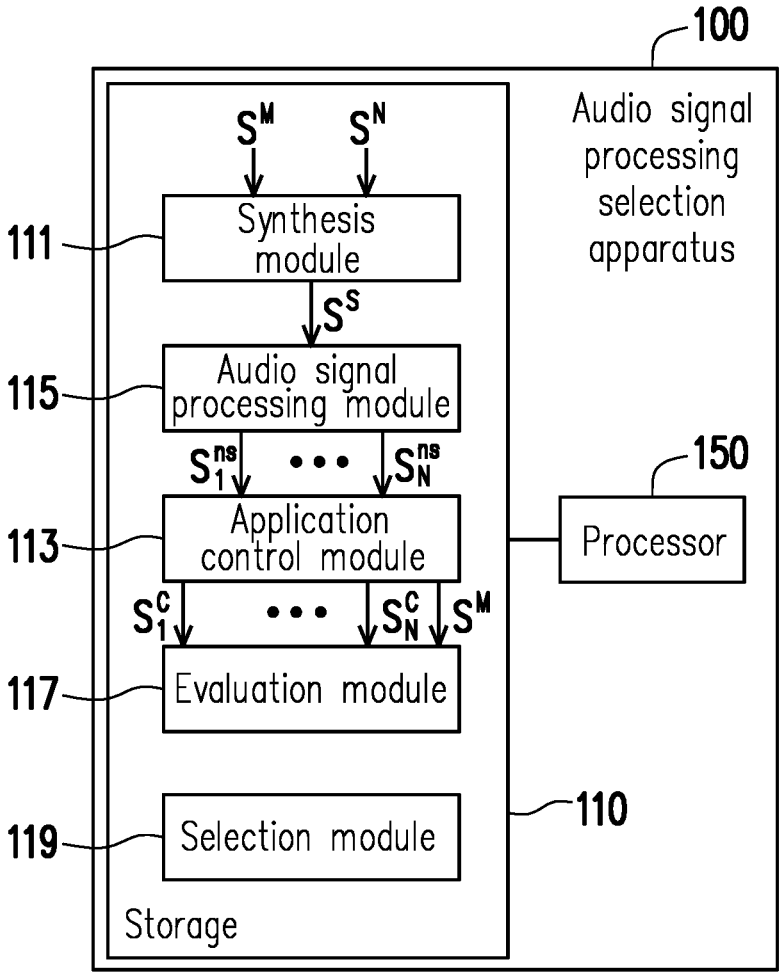
FIG. 2B is a block diagram illustrating the elements of an apparatus for audio signal processing selection according to an embodiment in the disclosure.

FIG. 2A is a block diagram illustrating a plurality of elements of an apparatus 100 for audio signal processing selection according to an embodiment in the disclosure, and FIG. 2B is a block diagram illustrating the elements of the apparatus 100 for audio signal processing selection according to an embodiment in the disclosure. Referring to FIG. 2A and FIG. 2B, the apparatus 100 for audio signal processing selection includes (but not limited to) a storage 110 and a processor 150. The apparatus 100 for audio signal processing selection may be a desktop computer, a laptop, an all-in-one (AIO) computer, a smartphone, a tablet computer, or a server, etc.

The storage 110 may be any type of fixed or mobile random access memory (RAM), read only memory (ROM), flash memory, hard disk drive (HDD), solid-state drive (SDD), or other similar devices. In an embodiment, the storage 110 is used to record programming codes, software modules (for example, a synthesis module 111, an application control module 113, an audio signal processing module 115, an evaluation module 117, and a selection module 119), a configuration setting, data, or a file (for example, an audio signal, a comparison result, and an evaluation result). Details of the above will be described in detail in the following.

The processor 150 is coupled to the storage 110, and the processor 150 may be a central processing unit (CPU), a graphic processing unit (GPU), or other programmable general-purpose or designated microprocessors, digital signal processor (DSP), programmable controller, field programmable gate array (FPGA), application-specific integrated circuit (ASIC), neural network accelerator, or similar device, or any combination of the above devices. In an embodiment, the processor 150 is used to execute some or all of the tasks of the apparatus 100 for audio signal processing selection and may load and execute each software module, code, file, and data stored in the storage 110.

In the following, a method according to an embodiment of the disclosure will be described with reference to the respective elements, modules, and signals of the apparatus 100 for audio signal processing selection. Each procedure in the method may be adjusted according to the practice, and is not limited thereto the following description.

Figure 3:
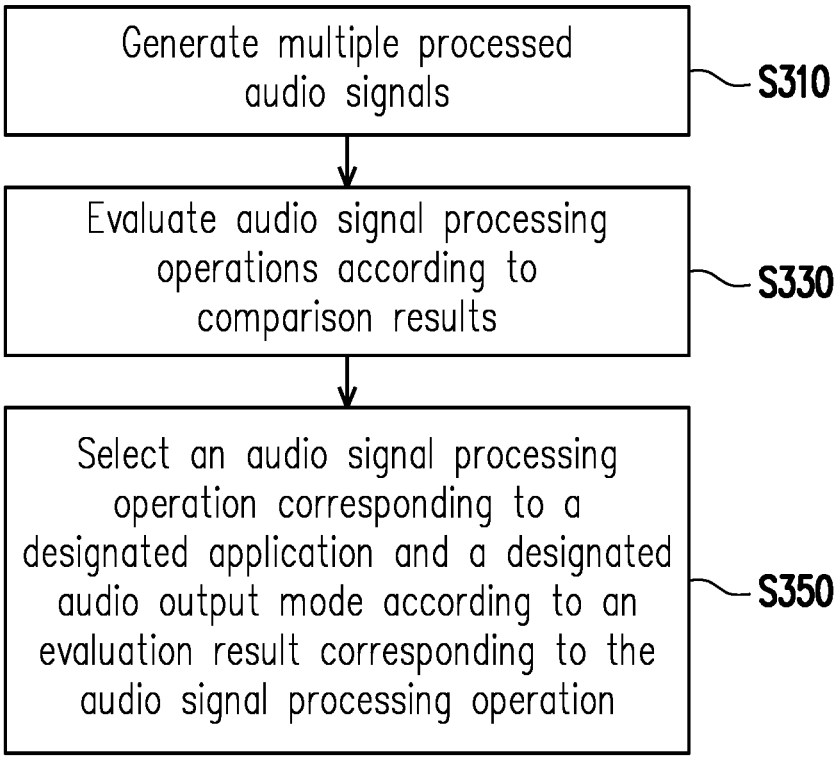
FIG. 3 is a flow chart of a method for audio signal processing selection according to an embodiment in the disclosure.

FIG. 3 is a flow chart of a method for audio signal processing selection according to an embodiment in the disclosure. Referring to FIG. 3, the audio signal processing module 115 respectively performs multiple audio signal processing operations on a synthesized audio signal $S^S$ to generate multiple processed audio signals $S_1^{ns}$ to $S_N^{ns}$ (N is a positive integer representing the number of the audio signal processing operations) (step S310). Specifically, the synthesized audio signal $S^S$ is generated by adding a secondary signal $S^N$ into a primary signal $S^M$ by the synthesis module 111. In other words, the synthesized audio signal $S^S$ may be generated by synthesizing the primary signal $S^M$ and the secondary signal $S^N$. The primary signal $S^M$ may be a simple speech signal (for example, a human voice signal without noise), a speech signal recorded by a sound receiver, or a blank silence signal (that is, a soundless signal). The secondary signal $S^N$ may be a sound generated by a creature (for example, a dog, a bird, or a baby), a sound of machine (for example, a compressor or an electric motor) operation, a synthetic sound, an ambient sound (for example, a sound of wind or bamboos striking), a sound from the interaction of objects (for example, a sound of a finger clicking a mouse, a sound of a ball bumping a wall), or any combination thereof. A sound which is not the primary signal $S^M$ may be considered the secondary signal $S^N$.

In an embodiment, the synthesis module 111, for example, may superimpose the two signals $S^M$ and $S^N$ on the frequency spectrum or adopt other synthesis techniques. In another embodiment, the apparatus 100 for audio signal processing selection may simultaneously play the primary signal $S^M$ and the secondary signal $S^N$ through a built-in, an add-on or an external loudspeaker and further record the signals so as to obtain the synthesized audio signal $S^S$.

On the other hand, in an embodiment, the audio signal processing operation on the synthesized audio signal $S^S$ performed by the audio signal processing module 115 is related to removing the secondary signal $S^N$ from the synthesized audio signal $S^S$. For example, one of the purposes of the audio signal processing operation is to restore the primary signal $S^M$ or eliminate noise. A noise reduction/cancellation (or sound source separation) technique, for example, generates a signal with a phase opposite to the phase of a noise sound wave or adopts independent components analysis (ICA) to eliminate noise (that is, the secondary signal $S^N$) from the synthesized audio signal $S^S$. The embodiments of the disclosure do not intend to limit the type of the techniques.

The signal outputs through different audio signal processing techniques based on the same input signal may differ regarding the frequency, the waveform, or the amplitude. If multiple audio signal processing techniques are to be evaluated, the audio signal processing module 115 may integrate the audio signal processing techniques and process the synthesized audio signal $S^S$ by respectively adopting different audio signal processing techniques. In addition, to understand a removal capability of a specific audio signal processing operation on different secondary signals $S^N$, the synthesis module 111 may also respectively incorporate different types of the secondary signals $S^N$ for subsequent evaluation training.

On the other hand, the application control module 113 may use the processed audio signals $S_1^{ns}$ to $S_N^{ns}$ all at the same designated audio output mode through the same designated application. The designated audio output mode is one of multiple audio output modes. The audio output mode is, for example, a built-in loudspeaker, an earphone, or an external loudspeaker. Loudspeakers or earphones of different types or different manufacturers may be considered different audio output modes. In addition, the designated application is one of multiple applications. The applications may use an audio signal. The application is, for example, a video communication software, voice call software, music software, or video player software. In the embodiment of the disclosure, the same application condition (that is, the same designated audio output mode and the same designated application) is evaluated and selected for the processed audio signals $S_1^{ns}$ to $S_N^{ns}$. In a practical operation, the application control module 113 may start up the designated application and set up the designated audio output mode, and use the input audio signal as an audio signal for recording or playing and input the signal into the designated application.

In an embodiment, referring to FIG. 2A, for an audio signal receiving end, the application control module 113 may process the synthesized audio signal $S^S$ with the designated application and output the processed signal through the designated audio output mode to generate a simulating output audio signal $S^C$. The simulating output audio signal $S^C$ is not required to really make any sound through a loudspeaker. In an embodiment, the audio signal processing module 115 may obtain the simulating output audio signal $S^C$ output by the designated application through a virtual audio cable (VAC) technique (that is, transmitting audio signal streaming among programs). Furthermore, the audio signal processing module 115 may respectively perform the audio signal processing operations of the receiving end on the simulating output audio signal $S^C$ (as the audio signal for playing) to generate the processed audio signals $S_1^{ns}$ to $S_N^{ns}$. That is, to evaluate the audio signal processing operations of the receiving end, it is required to first simulate the audio signal output by the designated application and the designated audio output mode and respectively perform the different audio signal processing operations on the audio signal.

In another embodiment, referring to FIG. 2B, for an audio signal transmitting end, the audio signal processing module 115 may respectively perform the audio signal processing operations of the transmitting end on the simulating output audio signal to generate the processed audio signals $S_1^{ns}$ to $S_N^{ns}$. Next, the application control module 113 may process the processed audio signals $S_1^{ns}$ to $S_N^{ns}$ (as audio signals for recording) with the designated application and output through the designated audio output mode to generate multiple stimulating output audio signals $S_1^C$ to $S_N^C$. That is, to evaluate the audio signal processing operations of the transmitting end, it is required to first simulate the audio signals processed by the different audio signal processing operations and output the audio signals with the designated application and the designated audio output mode.

The evaluation module 117 respectively evaluates the audio signal processing operations according to multiple comparison results between the processed audio signals $S_1^{ns}$ to $S_N^{ns}$ (or the simulating output audio signals $S_1^c$ to $S_N^C$) and the primary signal $S^M$ (step S330). Specifically, the evaluation module 117 compares the processed audio signals $S_1^{ns}$ to $S_N^{ns}$ output through the different audio signal processing operations with the primary signal $S^M$ so as to generate multiple comparison results. The comparison results are related to signal similarity. Signal similarity is, for example, similarity of voice print characteristics, semantic recognition (for example, correctness of a text content after a speech-to-text conversion), or the residual of the secondary signal $S^N$ (for example, the signal intensity in a certain frequency band). Various methods are available to compare signal similarity. For example, if the primary signal $S^M$ is a clean human voice signal without noise, the evaluation module 117 may adopt a comparison combining voice print characteristics and semantic recognition. Another example, if the primary signal $S^M$ is a blank silence signal, the higher similarity represents a weaker signal. In other words, for the comparison on the noise suppression capabilities of the audio signal processing operations, the weaker signals of the processed audio signals $S_1^{ns}$ to $S_N^{ns}$ represent the better noise suppression capability.

The evaluation module 117 may select one or more audio signal processing operations corresponding to the designated application and the designated audio output mode according to the evaluation result corresponding to the audio signal processing operations (step S350). Specifically, the evaluation result is related to the comparison results with the highest signal similarity. In other words, the higher signal similarity represents that the corresponding audio signal processing operation is more appropriate for the designated application and the designated audio output mode. On the other hand, the lower signal similarity represents that the corresponding audio signal processing operation is less appropriate for the designated application and the designated audio output mode. The evaluation module 117 may select one or more audio signal processing operations with the highest similarity, the second highest similarity, or other rankings from the audio signal processing operations and relate the selected audio signal processing operation to the designated application and the designated audio output mode.

For the evaluation on multiple applications and audio output modes, the application control module 113 may select another application and audio output mode as the designated application and the designated audio output mode, and the evaluation module 117 determines an appropriate audio signal processing operation for another application and audio output mode.

In an embodiment, the appropriate audio signal processing operation is already determined. When the designated audio output mode and the designated application are selected (that is, the application control module 113 determines a currently selected audio output mode as the designated audio output mode and a currently selected application as the designated application), the selection module 119 may use an audio signal processing operation selected according to the evaluation result to process the audio signal of the designated application. That is, the most appropriate audio signal processing operation is selected according to the evaluation result for the designated application and the designated audio output mode. For example, a user starts up a video communication software and sets up a loudspeaker output, the selection module 119 may select the audio signal processing operation corresponding to the video communication software and the loudspeaker output.

On the other hand, when the designated audio output mode and the designated application are not selected (that is, the application control module 113 determines a currently selected audio output mode is not the designated audio output mode and a currently selected application is not the designated application), the selection module 119 may switch to other audio signal processing operation. In other words, if the currently selected audio output mode is switched to a second designated audio output mode, and the currently selected application is switched to a second designated application, the selection module 119 may switch to an audio signal processing operation corresponding to the second designated application and the second designated audio output mode. For example, a user starts up a voice call software after finishing a video communication and sets up an earphone output, the selection module 119 may switch to an audio signal processing operation corresponding to the voice call software and the earphone output.

In summary, in the apparatus and the method for audio signal processing selection in the embodiments of the disclosure, an appropriate audio signal processing operation for a specific application and audio output mode is obtained through training. When an application and an audio output mode change, the method and the apparatus according to the embodiments of the disclosure may spontaneously switch to the most appropriate audio signal processing operation.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. A method for audio signal processing selection, the method comprising:

respectively performing a plurality of audio signal processing operations on a synthesized audio signal to generate a plurality of processed audio signals, wherein the synthesized audio signal is generated by adding a secondary signal into a primary signal, and the audio signal processing operations are related to removing the secondary signal from the synthesized audio signal;

respectively evaluating the audio signal processing operations according to a plurality of comparison results between the processed audio signals and the primary signal, wherein the processed audio signals are used by a designated application at a designated audio output mode, and the comparison results are related to a signal similarity; and selecting one of the audio signal processing operations corresponding to the designated application and the designated audio output mode according to an evaluation result corresponding to the audio signal processing operations, wherein the evaluation result is related to one of the comparison results with the highest similarity.

2. The method for audio signal processing selection according to claim 1, further comprising:

determining a currently selected audio output mode as the designated audio output mode;

determining a currently selected application as the designated application;

processing an audio signal of the designated application by using the audio signal processing operation selected according to the evaluation result in response to selecting the designated audio output mode and the designated application; and switching to another audio signal processing operation in response to not selecting the designated audio output mode and the designated application.

3. The method for audio signal processing selection according to claim 1, wherein generating the processed audio signals comprises:

processing the synthesized audio signal with the designated application and outputting through the designated audio output mode to generate a simulating output audio signal; and respectively performing the audio signal processing operations on the simulating output audio signal to generate the processed audio signals.

4. The method for audio signal processing selection according to claim 1, wherein generating the processed audio signals comprises:

processing the processed audio signals with the designated application and outputting through the designated audio output mode to generate a plurality of simulating output audio signals, wherein the simulating output audio signals serve to evaluate the audio signal processing operations.

5. The method for audio signal processing selection according to claim 3, wherein generating the processed audio signals comprises:

obtaining an audio signal output by the designated application through a virtual audio cable (VAC) technique.

6. The method for audio signal processing selection according to claim 4, wherein generating the processed audio signals comprises:

obtaining an audio signal output by the designated application through a VAC technique.

7. The method for audio signal processing selection according to claim 1, wherein evaluating the audio signal processing operations according to the plurality of comparison results between the processed audio signals and the primary signal comprises:

comparing similarities of voice print characteristics, semantic recognitions, or residuals of the secondary signal between the processed audio signals and the primary signal, to generate the plurality of comparison results.

8. The method for audio signal processing selection according to claim 1, wherein the designated audio output mode is a built-in loudspeaker, an earphone, or an external loudspeaker, and the designated application is a video communication software, voice call software, music software, or video player software.

9. An apparatus for audio signal processing selection, the apparatus comprising:

a storage storing a code; and a processor coupled to the storage and configured to load the code to execute:

respectively performing a plurality of audio signal processing operations on a synthesized audio signal to generate a plurality of processed audio signals, wherein the synthesized audio signal is generated by adding a secondary signal into a primary signal, and the audio signal processing operations are related to removing the secondary signal from the synthesized audio signal;

using the processed audio signals at a designated audio output mode by a designated application; and respectively evaluating the audio signal processing operations according to a plurality of comparison results between the processed audio signals and the primary signal and selecting one of the audio signal processing operations corresponding to the designated application and the designated audio output mode according to an evaluation result corresponding to the audio signal processing operations, wherein the comparison results are related to a signal similarity, and the evaluation result is related to one of the comparison results with the highest similarity.

10. The apparatus for audio signal processing selection according to claim 9, wherein the processor is further configured to:

determine a currently selected audio output mode as the designated audio output mode;

determine a currently selected application as the designated application;

process an audio signal of the designated application by using the audio signal processing operation selected according to the evaluation result in response to selecting the designated audio output mode and the designated application; and switch to another audio signal processing operation in response to not selecting the designated audio output mode and the designated application.

11. The apparatus for audio signal processing selection according to claim 9, wherein the processor is further configured to:

process the synthesized audio signal with the designated application and output through the designated audio output mode to generate a simulating output audio signal; and respectively perform the audio signal processing operations on the simulating output audio signal to generate the processed audio signals.

12. The apparatus for audio signal processing selection according to claim 9, wherein the processor is further configured to:

process the processed audio signals with the designated application and output through the designated audio output mode to generate a plurality of simulating output audio signals, wherein the simulating output audio signals serve to evaluate the audio signal processing operations.

13. The apparatus for audio signal processing selection according to claim 11, wherein the processor is further configured to:

obtain an audio signal output by the designated application through a virtual audio cable (VAC) technique.

14. The apparatus for audio signal processing selection according to claim 12, wherein the processor is further configured to:

obtain an audio signal output by the designated application through a VAC technique.

15. The apparatus for audio signal processing selection according to claim 9, wherein the processor is further configured to:

compare similarities of voice print characteristics, semantic recognitions, or residuals of the secondary signal between the processed audio signals and the primary signal, to generate the plurality of comparison results.

16. The apparatus for audio signal processing selection according to claim 9, wherein the designated audio output mode is a built-in loudspeaker, an earphone, or an external loudspeaker, and the designated application is a video communication software, voice call software, music software, or video player software.

* * * * *